US011077338B1

(12) United States Patent
Levin et al.

(10) Patent No.: US 11,077,338 B1
(45) Date of Patent: Aug. 3, 2021

(54) KNEE EXTENSION TRAINING DEVICE

(71) Applicants: Eduard Levin, Thornhill (CA); Gleb Gluhovsky, Olathe, KS (US); Jeffrey Lee Sawyer, Wichita, KS (US)

(72) Inventors: Eduard Levin, Thornhill (CA); Gleb Gluhovsky, Olathe, KS (US); Jeffrey Lee Sawyer, Wichita, KS (US)

( * ) Notice: Subject to any disclaimer, the term of this patent is extended or adjusted under 35 U.S.C. 154(b) by 49 days.

(21) Appl. No.: 16/873,114

(22) Filed: Feb. 4, 2020

(51) Int. Cl.

| | |
|---|---|
| ***A63B 23/04*** | (2006.01) |
| ***A63B 21/00*** | (2006.01) |
| ***A63B 21/068*** | (2006.01) |
| ***A63B 23/035*** | (2006.01) |
| ***A63B 23/00*** | (2006.01) |

(52) U.S. Cl.
CPC ..... *A63B 23/0494* (2013.01); *A63B 21/068* (2013.01); *A63B 21/4034* (2015.10); *A63B 23/03525* (2013.01); *A63B 2023/006* (2013.01); *A63B 2209/00* (2013.01); *A63B 2225/093* (2013.01)

(58) Field of Classification Search
CPC ..... A63B 23/0494; A63B 21/068; A63B 21/4034; A63B 23/03525; A63B 2209/00; A63B 2225/093; A63B 2023/006; A63B 23/00; A63B 23/035–03516
See application file for complete search history.

(56) References Cited

U.S. PATENT DOCUMENTS

| | | | | | |
|---|---|---|---|---|---|
| 3,850,430 | A * | 11/1974 | Hamilton | A63B 21/08 | 482/97 |
| 4,542,900 | A * | 9/1985 | Ray | A63B 23/0494 | 482/101 |
| 4,861,025 | A * | 8/1989 | Rockwell | A63B 21/06 | 482/142 |
| 5,499,961 | A * | 3/1996 | Mattox | A63B 21/055 | 482/123 |
| 6,361,482 | B1 * | 3/2002 | Batea | A63B 23/0355 | 482/100 |
| 7,678,033 | B2 * | 3/2010 | Tyree | A63B 21/4011 | 482/137 |
| 9,498,399 | B1 * | 11/2016 | Juntunen | A61H 1/024 | |
| 9,566,470 | B2 * | 2/2017 | Malizia | A61H 1/024 | |
| 9,630,055 | B2 * | 4/2017 | Runyan | A63B 21/0442 | |
| 2002/0119872 | A1 * | 8/2002 | Greenheck | A63B 23/0494 | 482/93 |
| 2004/0209745 | A1 * | 10/2004 | Riney | A63B 23/0494 | 482/97 |
| 2007/0155589 | A1 * | 7/2007 | Feldman | A63B 21/0023 | 482/9 |
| 2007/0225135 | A1 * | 9/2007 | Webber | A63B 23/02 | 482/140 |
| 2008/0096744 | A1 * | 4/2008 | Perry, Jr. | A61H 1/0292 | 482/144 |
| 2013/0145649 | A1 * | 6/2013 | Killion | A43B 13/184 | 36/27 |
| 2016/0296794 | A1 * | 10/2016 | Land | A63B 21/00047 | |
| 2018/0000679 | A1 * | 1/2018 | Malone | A63B 23/04 | |
| 2019/0217154 | A1 * | 7/2019 | Kane | A63B 21/4029 | |

* cited by examiner

*Primary Examiner* — Andrew S Lo

(57) ABSTRACT

A knee extension training device is provided with knee abutment rolls, heel abutment rolls and feet anchor rolls to facilitate a user from standing on the device in an upright manner with the knees, the heels, and the feet abutting the respective abutment rolls such that knee extension stretching and flexion exercise can be carried out by utilizing the user's own body weight.

14 Claims, 11 Drawing Sheets

KNEE EXTENSION TRAINING DEVICE

BACKGROUND OF THE INVENTION

This invention relates to devices for facilitating a user to carry out exercises of knee training by flexing and stretching to strengthening the knee joints.

People in occupations requiring repetitive kneeling, squatting, lifting of heavy weights, or athletes particularly in soccer, tennis, or long-distance running are prone to develop osteoarthritis of the knees. They experience decrease in the range of motion as well as significant stiffness and pain in the knee joints.

Regular moderate exercise or training can provide treatment to strengthen joints and to reduce pain and it can decrease the risk of osteoarthritis. The treatment plan will typically include a combination of the following regime: reducing body weight, exercise, and ingesting pain relievers and anti-inflammatory and non-steroidal drugs. Strengthening the muscles around the knees is an effective way to make the joint more stable and to facilitate the decrease of pain.

SUMMARY OF THE INVENTION

The object of the present invention is to utilize the person's own body weight to perform knee extension training exercise for strengthening the quadriceps muscles so as to reduce stiffness and pain in the knee joints. Such strengthening is achieved with the fulcrum principle by maintaining the feet, ankle and legs of the person stationary with the support of adjustable knees, ankles, and feet braces in the form of abutment rolls while using the person's own body weight to perform stretching or extension and flexion of the knees.

The device for carrying out the above object comprises an adjustable base frame assembly provided with an adjustable body support assembly, an adjustable ankle support assembly, and an adjustable foot support or anchor assembly. The device facilitates the exercise of alternating flexion and extension of the knees to result in increase in strength and agility of the quadriceps muscles thus improving the stability of the knee joints without applying axial loading to the joints and without causing wear and tear on the knee joint cartilage.

The device allows the user to minimize axial loading of the knee joints while still benefitting from increase of the knee range of motion and the strengthening of the quadriceps muscles.

BRIEF DESCRIPTION OF THE DRAWINGS

In the drawings which illustrate the essence of the invention.

DETAILED DESCRIPTION OF THE PREFERRED EMBODIMENTS

Figure 1:
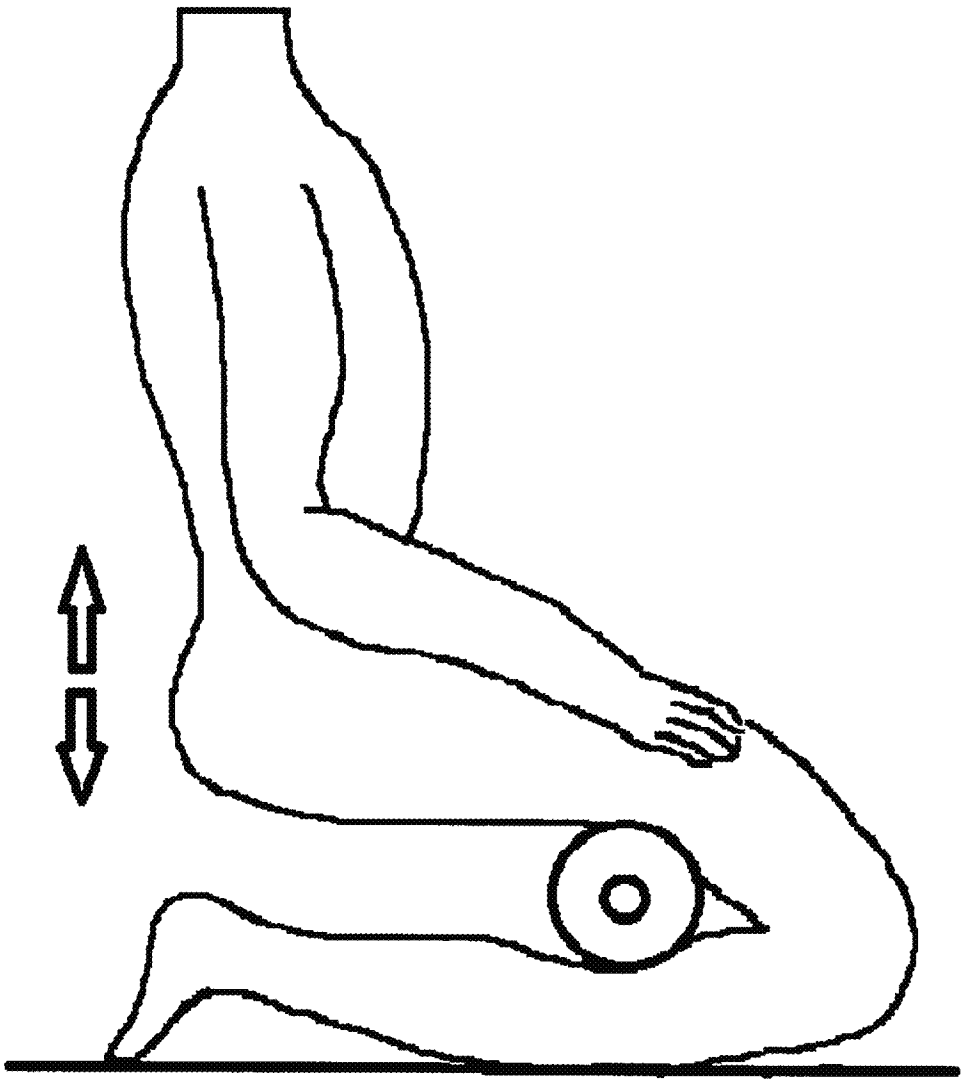
FIG. 1 is a pictorial illustration showing the positioning of a roll between the thigh and leg of a person in a seating position to utilize the person's own weight for stretching the knee joint.
Figure 2:
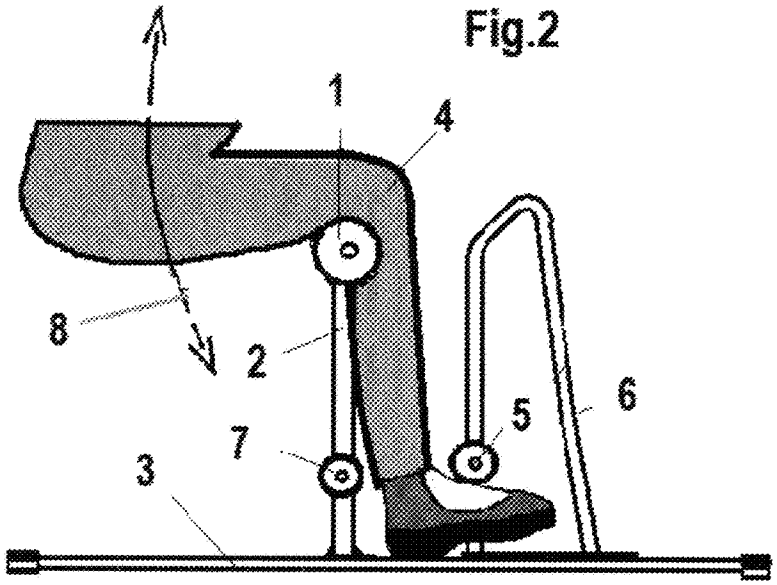
FIG. 2 is a perspective side elevation view of a basic device for carrying out knee stretching exercise.
Figure 3:
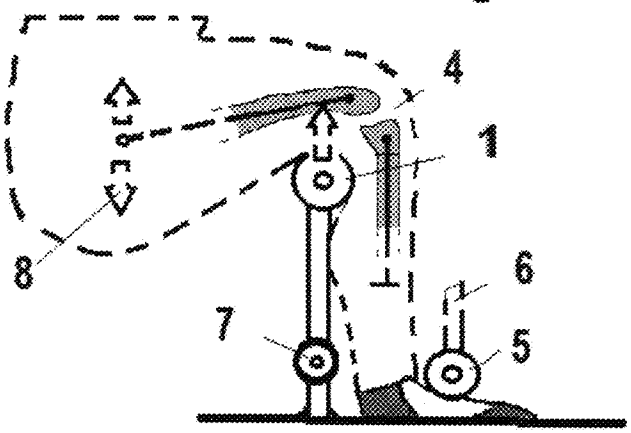
FIG. 3 is a perspective side elevation view showing the operation of the device in FIG. 2 for using a person's own body weight as a lever to perform stretching exercise of the knee joint.

The principle and method of knee stretching is shown in FIGS. 1 and 2 which facilitate static stretching position of the knee joints without resulting in hamstring strengthening. In the illustration in FIG. 1 a roll is placed between the thigh and the leg of a person in a sitting position. The person can then move the body up and down in the vertical direction as shown by the arrows such that the person's own weight exerts a stretching action on the knee joints. Alternatively, the knee stretching exercise may be carried out with support rolls 1 mounted horizontally on top a vertical support rod 2 extending upright on a main base frame 3 so that a person may support the body in a sitting position on the support rolls 1 with the rolls positioned at the back of the knees 4. A foot support consisting of feet abutment rolls 5 mounted in a horizontal position on a second support 6 allow the person to butt the upper of the feet against the feet abutment rolls 5 so as to maintain the person to position securely in the sitting position with the body in an upright vertical manner. Additional ankle abutment rolls 7 may also be provided to abut the back of the ankles to provide additional body stabilizing means to maintain the balance and stability of the body in performing the exercise. As best shown in FIG. 2, the person may then exercise the quadriceps muscles of flexing and extending the knees by elevating and lowering the body as shown by the arrows 8 for stretching the knee joints at a selected desirable pace with the person's own weight. As shown in FIG. 3, while the lower legs and feet are maintain fixed, the person's own body weight above the knees is used as a counter balance resulting in increase of the intra-articular space of the knees during the stretching exercise.

Figure 4:
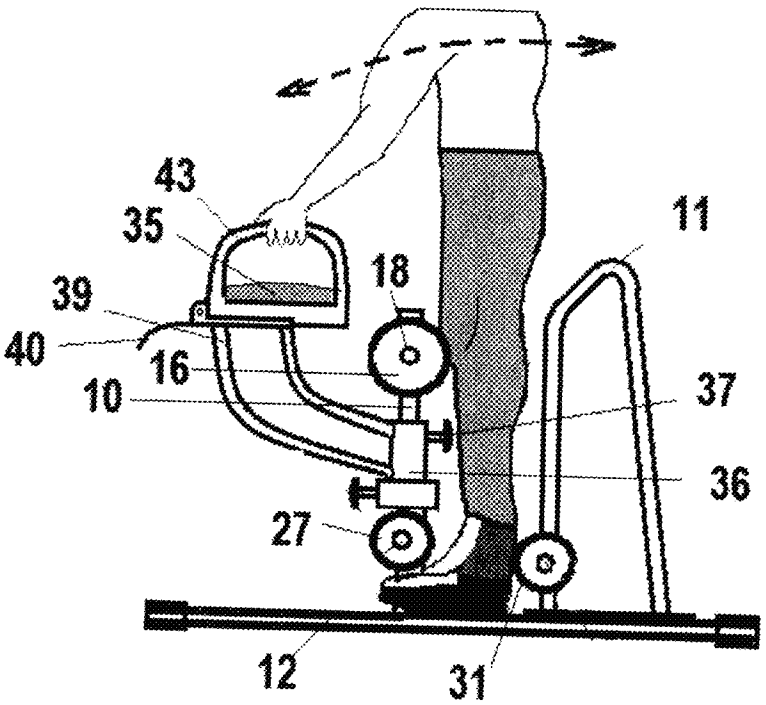
FIG. 4 is a perspective side elevation view of the device according to the present invention showing a user standing in an upright manner in using the device for carrying out knee stretching exercise by utilizing the user's own body weight.
Figure 5:
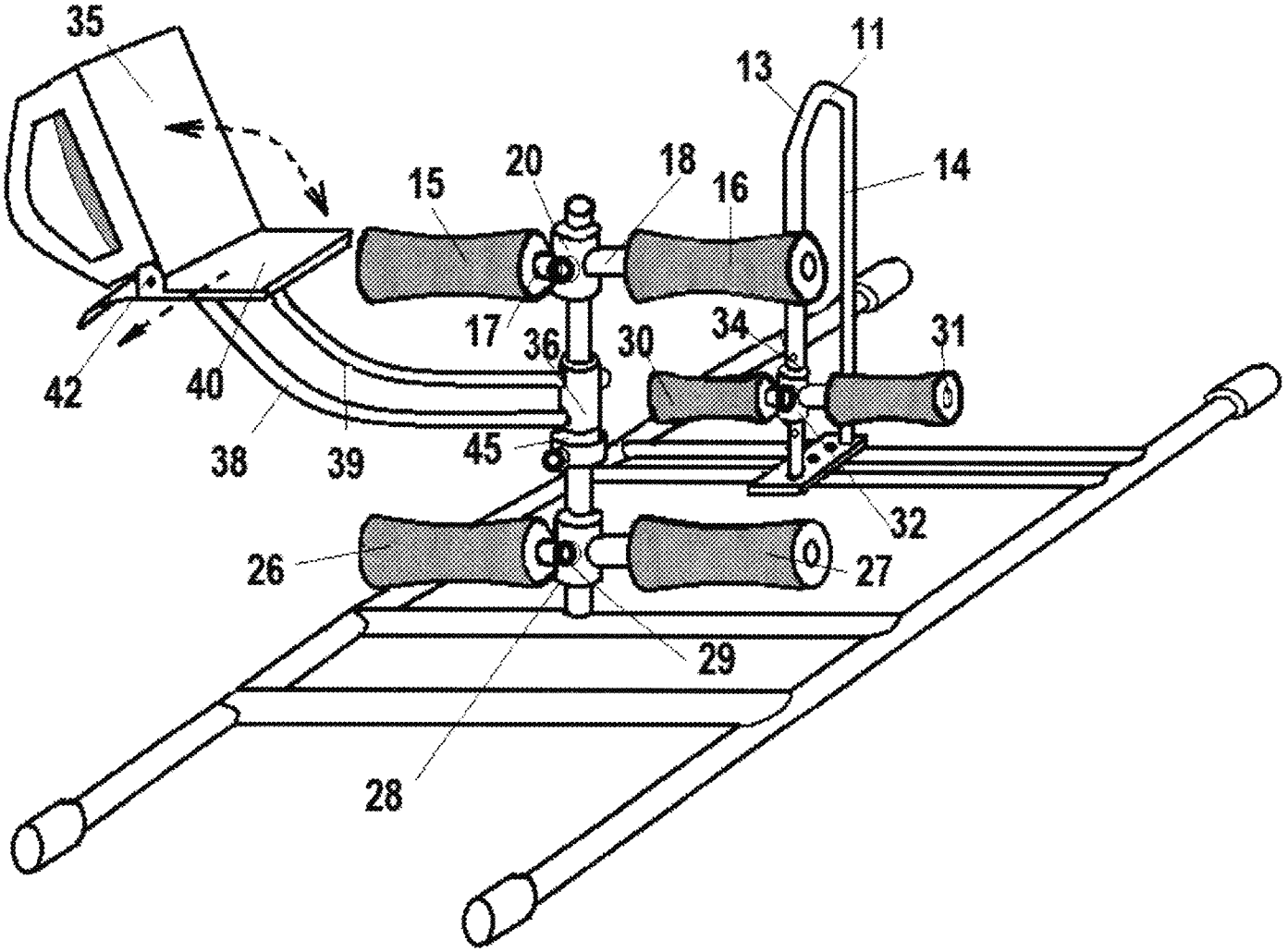
FIG. 5 is a perspective top and side elevation view of the device according to the present invention.

As shown in FIGS. 4 and 5, the device according to the present invention includes a vertical mounting rod 10 and a generally inverted U-shaped mounting bracket 11, mounted on a main base frame 12. The inverted U-shaped mounting bracket 11 has a front rod 13 and a rear reinforcing support rod 14. The vertical mounting rod 10 and the front rod 13 of the inverted U-shaped mounting bracket 11 are spaced from one another to allow a user of the device to stand between them to perform the knee stretching exercise according to the present invention. Two knee abutment rolls 15 and 16 are mounted at the upper portion of the vertical mounting rod 10. The knee abutment rolls 15 and 16 extend in a horizontal manner on directly opposite sides to one another such that the knee abutment rolls 15 and 16 will abut the knees of the user standing in the device as best shown in FIG. 4. The knee abutment rolls 15 and 16 consist of bars 17 and 18 having a soft or resilient material wrapped on their outer surface. The soft or resilient material protects the user's body from trauma during exercise.

Figures 10A, 10B:
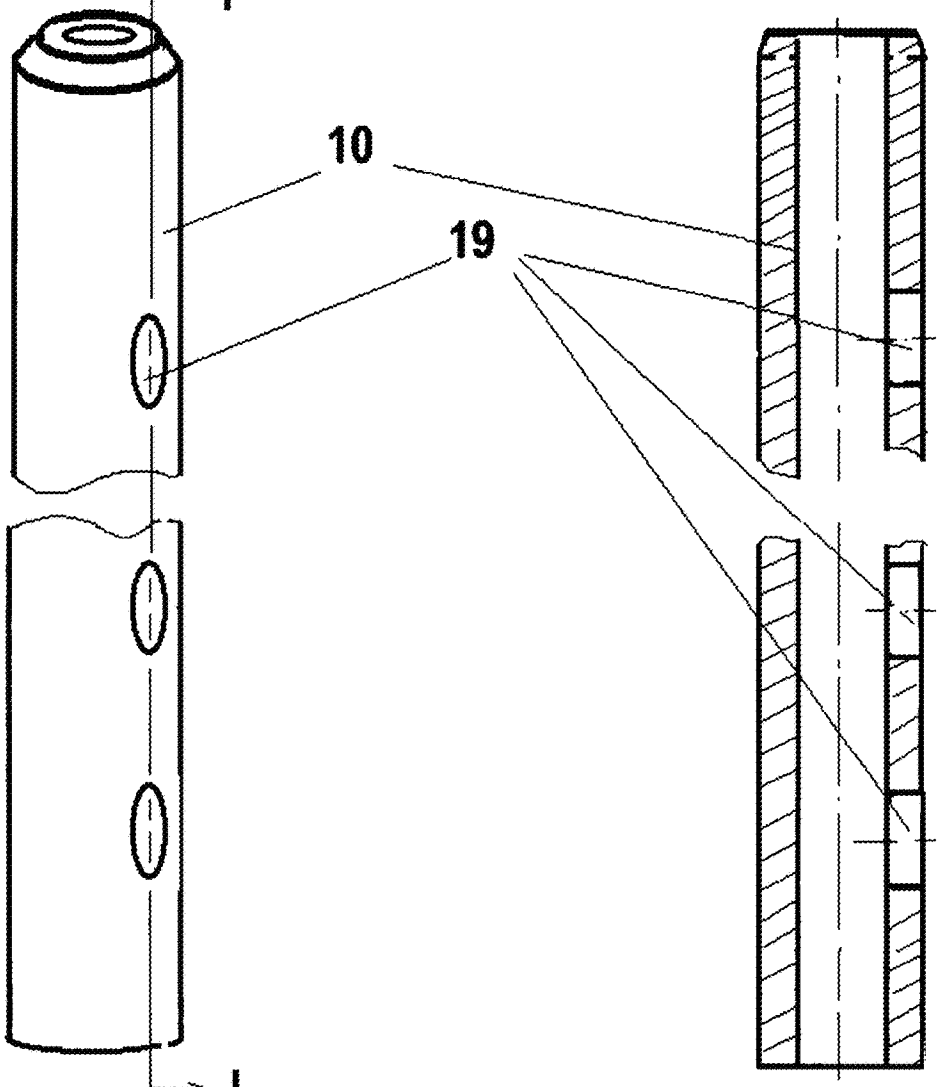
FIG. 10A is a perspective top and side elevation view of the vertical support for mounting the knee abutment rolls, feet anchor rolls and seat assembly on the device.
FIG. 10B is a sectional side elevation view of the vertical support rod of FIG. 10A along longitudinal section line I-I.

As best shown in FIGS. 10A and 10B, the vertical mounting rod 10 is preferably a cylindrical tube having a plurality to round positioning openings 19 formed on its front side along a straight longitudinal line over the entire length of the vertical mounting rod 10.

Figure 6:
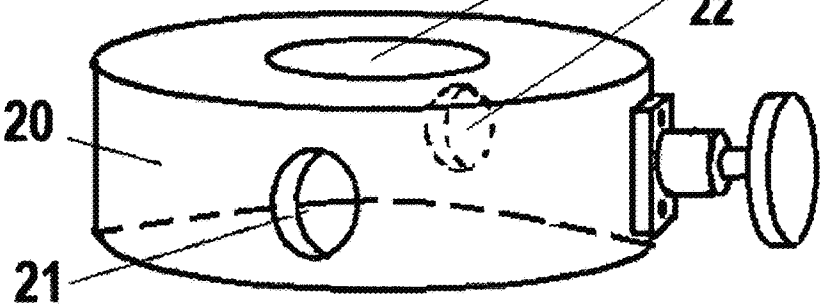
FIG. 6 is a perspective top and side elevation view of the adjustable abutment collar for maintaining the abutment rolls, ankle rolls, and feet anchor rolls at a selected heights on the device.
Figure 7:
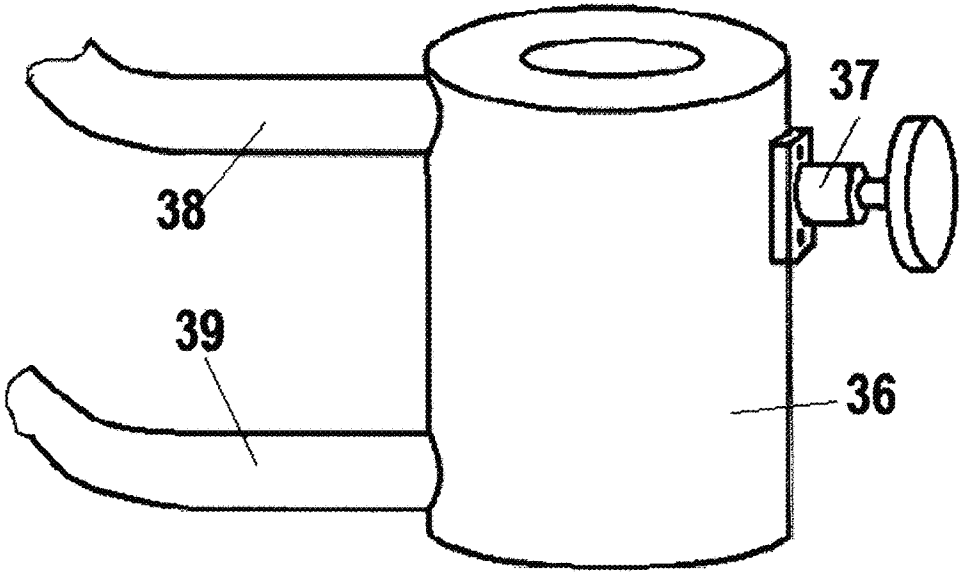
FIG. 7 is a perspective top and side elevation view of the adjustable mounting collar for mounting the seat assembly on the device.
Figure 12:
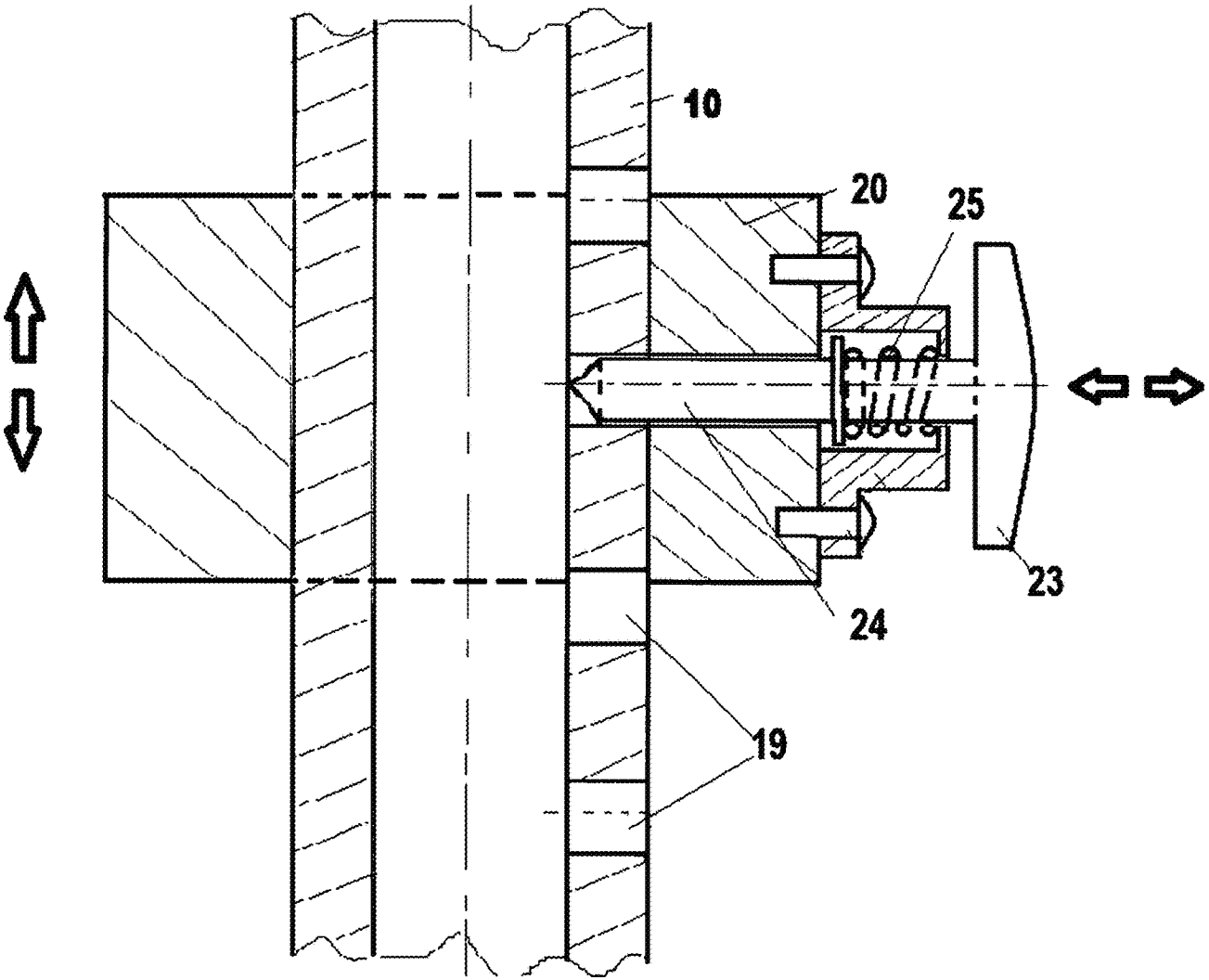
FIG. 12 is a partial sectional side elevation view of the abutment collar mounted on the vertical support rod.

As best shown in FIGS. 6 and 12, an annular-shaped adjustable upper collar 20 is provided for mounting the bars 17 and 18 on the vertical mounting rod 10. Two mounting openings 21 and 22 are formed on diametrically opposite sides of the upper collar 20, and the inner end of bars 17 and 18 are inserted into the mounting openings 21 and 22 respectively such that the knee abutment rolls 15 and 16 are extending in an cantilever manner at diametrically opposite sides of the upper collar 20. The upper collar 20 has a central opening 23 having a diameter equal to the diameter of the vertical mounting rod 10 such that the upper collar 20 with the knee abutment rolls 15 and 16 mounted thereon can be slidably mounted onto the vertical mounting rod 10 by engaging the central opening 23 with the vertical mounting rod 10. As best shown in FIG. 12, a T-shaped plunger 23 is provided at the side of the upper collar 20 and positioned at 90 degrees to the mounting openings 21 and 22. The plunger 23 has an inner end portion 24 extending normally inward a short distance into the central opening 23 of the collar 20 under the spring force of a bias spring 25. The plunger 23 can be pulled outwards against the bias spring force to retract its inner end portion 24 back into the upper collar 20 for mounting the collar together with the rolls slidably onto the vertical mounting rod 10. The position of the upper collar 20 on the mounting rod 10 is adjustable by sliding the collar 10 up and down the vertical mounting rod 10 until the knee abutment rolls 15 and 16 are at the position abutting the knees of the user standing in the device. At which point, the plunger 23 may be released such that its inner end extends back inside the collar by the bias spring 25 to engage with the selected positioning opening 19 on the vertical mounting rod 10 to latch the knee abutment rolls 15 and 16 fixedly at the selected positions abutting the knees of the user.

Two feet anchor rolls 26 and 27 are mounted to the lower end portion of the vertical mounting rod 10 with a lower collar 28. The feet anchor rolls 26 and 27 and the lower collar 28 have similar construction as knee abutment rolls 15 and 16 and upper collar 20. The lower collar 28 may be slidably adjustable to mount the two feet anchor rolls 26 and 27 at a selected position and latched fixedly in place by the spring-bias plunger 29 for abutting the upper of the feet of the user standing in the device of the present invention as best shown in FIG. 4 so as to maintain the user in a stable standing position inside the device while performing the knee stretching and flexion exercise.

Figure 11:
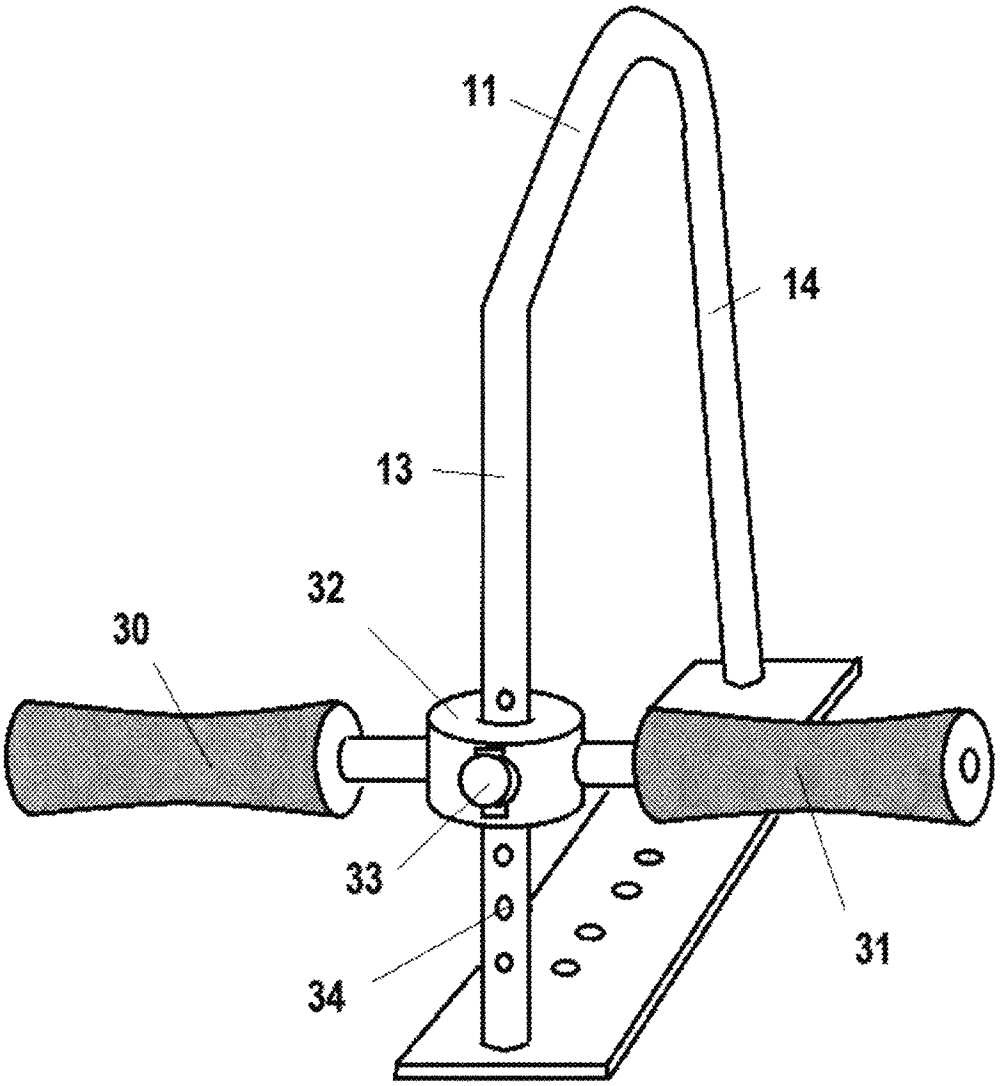
FIG. 11 is a perspective top and side elevation of the ankle support assembly of the device according to the present invention.

Two heel abutment rolls 30 and 31 are mounted on the front rod 13 of the inverted U-shaped mounting bracket 11 with a third collar 32 having a latching plunger 33. The heel abutment rolls and the third collar 32 have the same constructions as the knee abutment rolls 15 and 16 as well as the feet anchor rolls 26 and 27 and the upper and lower collars 20 and 28. As shown in FIG. 11, the position of the third collar 32 may be adjustable slidably up and down the front rod 13 to latch in position with the inner end of the latching plunger 33 engaging with a selected opening of a plurality of mounting openings 34 formed on the front side along a vertical line of the front rod 13 of the inverted U-shaped mounting bracket 11. The position of the heel abutment rolls 30 and 31 are adjustable in this manner to abut the heels of the user standing securely in the device of the present invention for performing the knee extension and flexion exercise.

Figure 8:
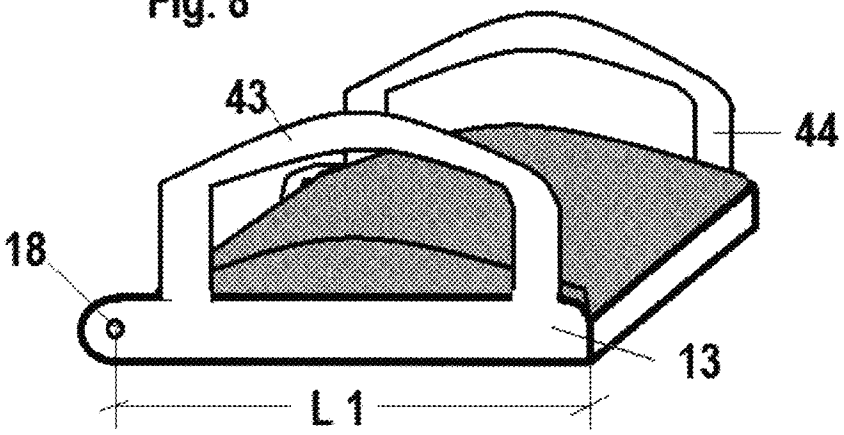
FIG. 8 is a perspective top and side elevation view of the seat.
Figure 9:
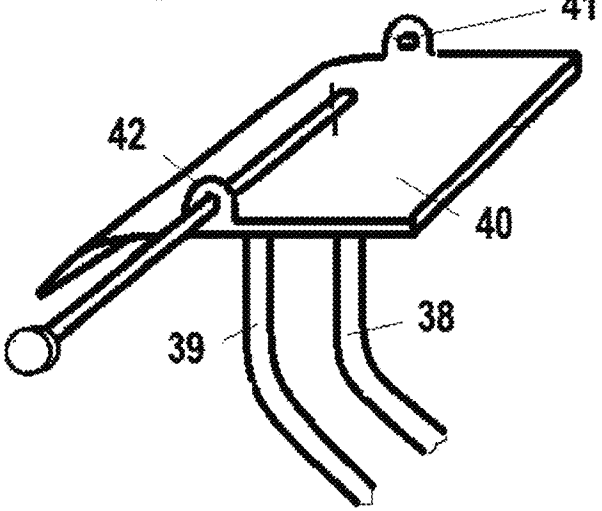
FIG. 9 is a perspective top and side elevation view of the seat support of the seat assembly.

As best shown in FIGS. 4 and 5, a seat 35 is mounted to the vertical mounting rod 10 by a fourth collar 36 having a latching spring bias plunger 37. The seat 35 is mounted to the fourth collar 36 by two elongated inverted L-shaped arms 38 and 39. The lower end of the arms 38 and 39 are mounted to the fourth collar 36 and their upper ends are mounted to the bottom surface of a seat supporting plate 40. As shown in FIGS. 8 and 9, the seat 35 is pivotally mounted to the supporting plate 40 with rear hinges 41 and 42. Two inverted U-shaped handles 43 and 44 are provided on the two sides of the seat 35. The height of the seat 35 above ground may be adjusted by sliding the fourth collar 36 up and down the vertical mounting rod 10. An additional retaining collar 45 may be mounted on the vertical mounting rod 10 and located below the fourth collar 36 to provide additional support for the seat assembly. The handles 43 and 44 facilitate the user from holding on to them during the knee stretching and flexion exercise for maintaining in a stable standing manner.

Figure 13:
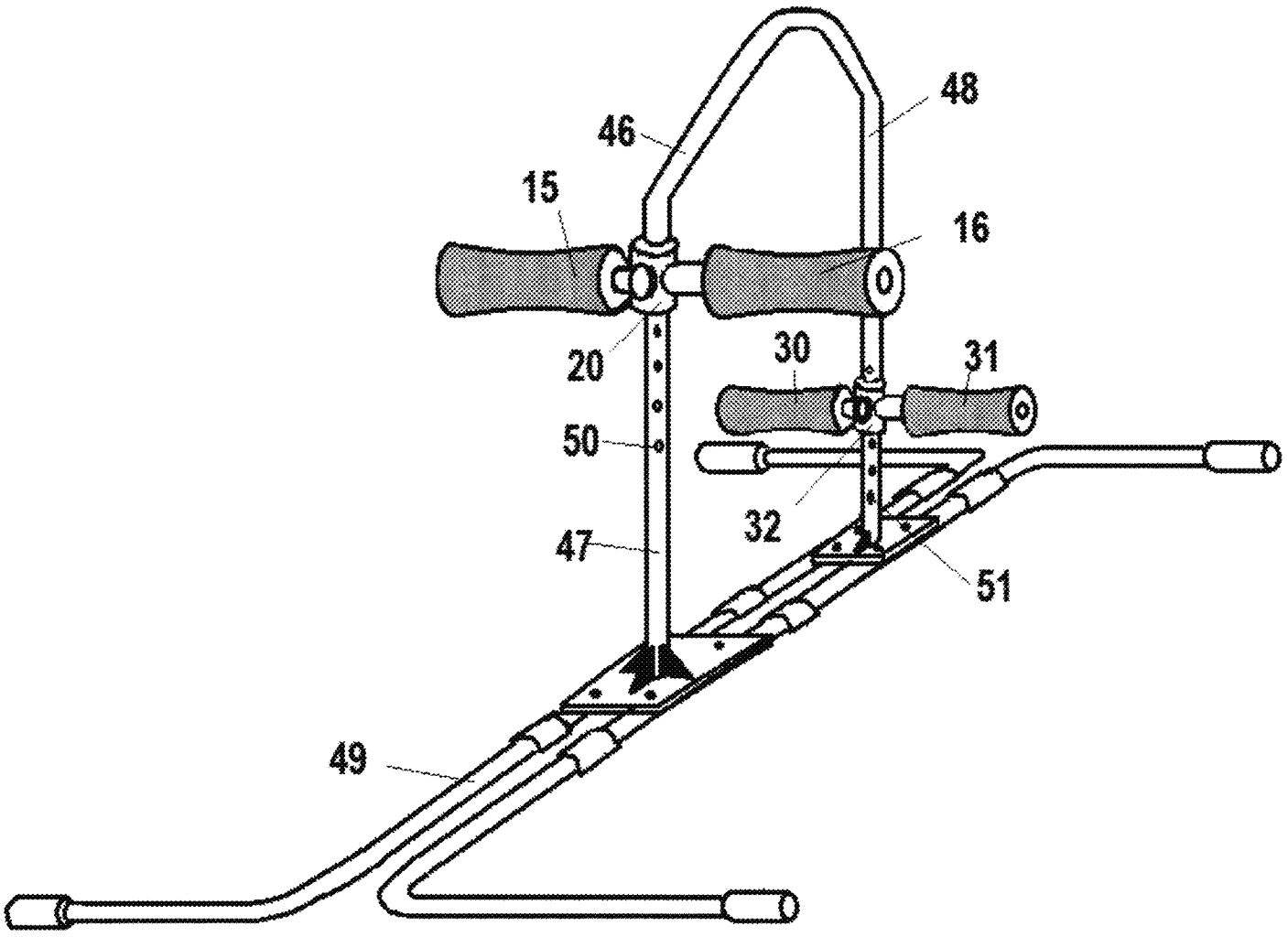
FIG. 13 is a top and front perspective elevation view a first simplified embodiment of the device of the present invention having only body and ankle supports.
Figure 14:
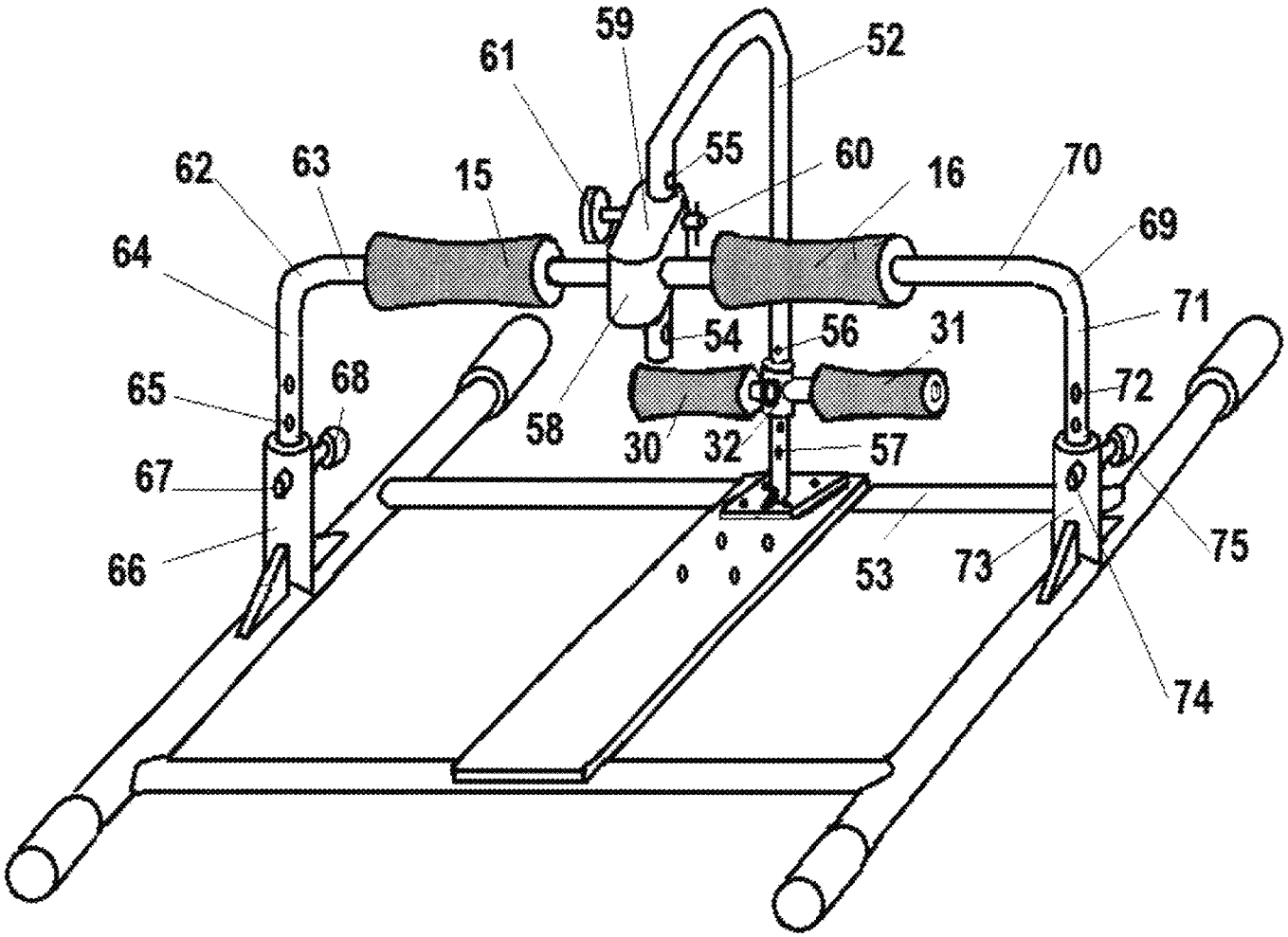
FIG. 14 is a top and front perspective elevation view showing a second embodiment the of the device having an alternative base support frame

Basic knee training exercise may be conducted with simplified versions of the device according to the present invention as shown in FIGS. 13 and 14 in which only knee abutment rolls and heel abutment rolls are provided. In the first embodiment as shown in FIG. 13, the device has a generally inverted U-shaped mounting frame 46 having a vertical front mounting arm 47 and a rear mounting arm 48 extending upwards from a support frame 49. A plurality of positioning openings 50 are formed along a longitudinal straight line in the front surface of the front mounting arm 47 similar to the vertical mounting rod 10 with the plurality of positioning openings 19, and a plurality of mounting openings 51 are provided on the front surface of the rear mounting arm 48 similar to the front rod 13, in the above preferred embodiment. The knee abutment rolls 15 and 16 and the mounting collar 20 are slidably mounted to the front mounting arm 47 and the heel abutment rolls and mounting collar 31 are slidably mounted to the rear mounting arm 48.

In the second embodiment as shown in FIG. 14, an inverted J-shaped mounting bracket 52 is provided on the support base frame 53. The inverted J-shaped mounting bracket 52 has a front overhang arm 54 having a plurality of diametrically through mounting openings 55 formed therein. The rear vertical arm 56 has a plurality of mounting openings 57 formed on its front surface along a straight line in its lower portion similar to the front rod 13 of the above preferred embodiment. The heel abutment rolls 30 and 31 and the mounting collar 32 are slidably mounting on the rear vertical arm 56. The knee abutment rolls 15 and 16 are mounted at their inner ends to front portion of a collar block 58 which has a vertical through mounting opening 59 such that the collar block 58 together with the knee abutment rolls 15 and 16 can be slidably mounted on the front overhang arm 54. The collar block 58 has a transverse through opening 60 extending across the collar block 58 from side to side and through the mounting opening 59. A securing pin 61 may be inserted through the transverse through opening 60 to latch the collar block 58 in place at the selected height when the knee abutment rolls 15 and 16 are abutting against the knees of the user. A first inverted L-shaped arm 62 having a horizontal arm 63 mounted to the outer end of the knee abutment roll 15. The inverted L-shaped arm 62 has a vertical arm 64 with a plurality of transverse mounting openings 65 formed in its lower portion. The vertical arm 64 is slidably insertable into an upstanding cylindrical mounting sleeve 66 extending upward from the base support frame 53. A transverse through opening 67 is formed in the mounting sleeve 66 such that a pin 68 may be inserted into the mounting sleeve 66 to secure the vertical arm 64 to the mounting sleeve 66. Similarly, a second inverted L-shaped arm 69 is mounted to the outer end of the knee abutment roll 16 with a horizontal arm 70 therein. The second inverted L-shaped arm 69 has a vertical arm 71 provided with a plurality of transverse through mounting openings 72. The vertical arm 71 is slidably insertable into a mounting sleeve 73 extending upward from the base supporting frame 53. A transverse through opening 74 is formed in the mounting sleeve 73 such that a pin 75 may be inserted through the transverse through opening 74 to latch the inverted L-shaped arm 69 in place.

What is claimed is:

1. A knee extension training device comprising:

a base supporting frame, a first vertical mounting rod located at a front portion of said base supporting frame, a second vertical mounting rod located at a rear portion of said base supporting frame and spaced from said first vertical mounting rod, a plurality of first mounting openings formed on said first vertical mounting rod, a plurality of second mounting openings also formed on said second vertical mounting rod, a first annular mounting collar having a central opening and two diametrically opposite through openings, said first annular mounting collar being slidably mountable on said first vertical mounting rod with said central opening therein engaging with said first vertical mounting rod, two knee abutment rolls mounted at diametrically opposite sides of said first annular mounting collar, a first securing plunger provided at said first annular mounting collar for latching said first annular mounting collar at a selected position on said first vertical mounting rod, a second annular mounting collar having a central opening and two diametrically opposite through openings, said second annular mounting collar being slidably mountable on said second vertical mounting rod, two heel abutment rolls mounted at diametrically opposite sides of said second annular mounting collar, and a second securing plunger provided at said second annular mounting collar for latching said second annular mounting collar at a selected position on said second vertical mounting rod.

2. A knee extension training device according to claim 1 wherein said first vertical mounting rod is a tubular rod extending in an upright manner on said base support frame and said first mounting openings are round openings formed on a front surface along a straight line of an upper portion of said first vertical mounting rod, and said second mounting openings are openings formed on a front surface along a straight line of a lower portion of said second vertical mounting rod.

3. A knee extension training device according to claim 2 wherein said first securing plunger is a T-shaped pin extending through said first annular collar and having an inner end portion engaging with a selected one of said first mounting openings.

4. A knee extension training device according to claim 1 wherein said first vertical mounting rod is a vertical front leg of a generally U-shaped bracket, and said second vertical mounting rod is a vertical rear leg of said U-shaped bracket.

5. A knee extension training device according to claim 1 wherein said first vertical mounting rod is a vertical front leg of a J-shaped bracket and said front leg extending above said base frame in an overhanging spaced manner, and said second vertical mounting rod is a vertical rear leg of said J-shaped bracket, said vertical rear leg being mounted to said base frame.

6. A knee extension training device according to claim 5 including two inverted L-shaped bars each having a horizontal arm attached to an outer end of a respective one of said knee abutment rolls, and a downwardly extending outer end of each said inverted L-shaped bars being slidably engageable with an upstanding sleeve on said base frame.

7. A knee extension training device according to claim 6 including a plurality of through openings formed on each of said downwardly extending end of said inverted L-shaped bars, a mounting through opening formed in said sleeve, a mounting pin insertable through said mounting through opening and a selected one of said through openings of a respective inverted L-shaped bar to latch said inverted L-shaped bar to said sleeve.

8. A knee extension training device comprising:

a base supporting frame, a vertical mounting rod located at a front portion of said base supporting frame, a plurality of first mounting openings formed along a straight line on a front surface of an upper portion of said vertical mounting rod, a first mounting collar slidably mounted on said vertical mounting rod, two knee abutment rolls mounted on said first mounting collar and extending outward in diametrically opposite sides of said first mounting collar, a first securing plunger mounted on said first mounting collar, said first securing plunger having an inner end portion extending transversely through said first mounting collar to engage with a selected one opening of said first mounting openings, a rear mounting bracket located in an upright manner at a rear portion of said base supporting frame, said rear mounting bracket having a vertical arm, a plurality of second mounting openings formed along a straight line on a front surface of said vertical arm, a second mounting collar slidably mounted on said vertical arm of said rear mounting bracket, a second securing plunger mounted on said second mounting collar, said second securing plunger having an inner end portion extending transversely through said second mounting collar to engage with a selected one opening of said plurality of said second mounting openings, two heel abutment rolls mounted on said second mounting collar and extending outward in diametrically opposite sides of said second mounting collar, a third mounting collar slidably mounted on said vertical mounting rod and located at a lower portion of said vertical mounting rod, two feet abutment rolls mounted on said third mounting collar and extending outward in diametrically opposite sides of said third mounting collar, a third securing plunger mounted on said third mounting collar and operative for latching said third mounting collar at a selected position on said vertical mounting rod.

9. A knee extension training device according to claim 8 including a fourth mounting collar slidably mounted to said vertical mounting rod, a seat assembly mounted to said fourth mounting collar.

10. A knee extension training device according to claim 9 wherein said seat assembly includes two elongated arms having a lower end secured to said fourth mounting collar and an outer end secured to a bottom surface of a seat support plate, a seat hingedly mounted to said seat support plate, and said seat having two side arms.

11. A knee extension training device according to claim 10 including a fifth mounting collar slidably mounted on said vertical mounting rod and located below said fourth mounting collar to provide additional support for said seat assembly.

12. A knee extension training device according to claim 11 wherein said knee abutment rolls, heel abutment rolls, and feet anchor rolls are elongated bars having a soft material wrapped on their outer surface.

13. A knee extension training device according to claim 12 wherein said vertical mounting rod is a tubular rod and said rear bracket is a generally inverted U-shaped bracket having a vertical front leg, and said heel abutment rolls are mounted on said vertical front leg.

14. A knee extension training device according to claim 13 wherein said first securing plunger, said second securing plunger, said third securing plunger, and said fourth securing plunger are T-shaped pins mounted with a bias spring in respective mounting collars, and an inner end portion of a respective plunger is normally extending through respective mounting collars to engage with selected mounting openings for latching said mounting collars at selected positions.

* * * * *